United States Patent [19]

Rüger

[11] 4,087,929

[45] May 9, 1978

[54] JALOUSIE STRUCTURE

[75] Inventor: Walther Rüger, Munich, Germany

[73] Assignee: Refeka Werbemittel GmbH, Heimstetten, Germany

[21] Appl. No.: 684,729

[22] Filed: May 10, 1976

[30] Foreign Application Priority Data

Apr. 5, 1976 Germany ..... 7610543[U]

[51] Int. Cl.[2] ..... G09F 11/00

[52] U.S. Cl. ..... 40/488

[58] Field of Search ..... 40/61, 62, 137, 28 R; 46/37

[56] References Cited

U.S. PATENT DOCUMENTS

| | | | |
|---|---|---|---|
| 718,305 | 1/1903 | Blanchard | 40/62 |
| 729,599 | 6/1903 | Jolly | 40/137 X |
| 1,967,658 | 7/1934 | Buescher | 40/137 |
| 2,799,105 | 7/1957 | Tilley | 40/62 |
| 2,961,788 | 11/1960 | Halperin | 40/137 |
| 3,430,372 | 3/1969 | Ruthchick | 40/61 |

FOREIGN PATENT DOCUMENTS

| | | | |
|---|---|---|---|
| 374,163 | 6/1932 | United Kingdom | 40/137 |

*Primary Examiner*—Louis G. Mancene
*Assistant Examiner*—Wenceslao J. Contreras

[57] ABSTRACT

The jalousie card according to the invention, includes a display card in combination with a jalousie mounted in front of the display area of the card. The display card is provided with a pair of parallel slots through which a display sheet is threaded into the display area. The jalousie includes a window frame attached to the display card, and a plurality of parallel and interconnected lamellaes that are pivotally mounted within the frame. Pull movement of the jalousie frame causes, in turn, movement of the lamellaes from a covered position about the display area of the card to an open position exposing the same, and vice versa.

16 Claims, 6 Drawing Figures

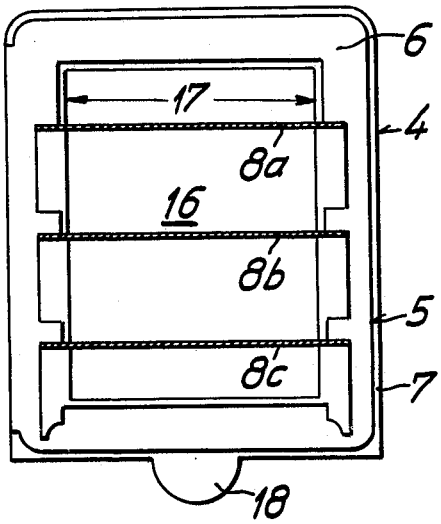
Fig.3
Fig.1
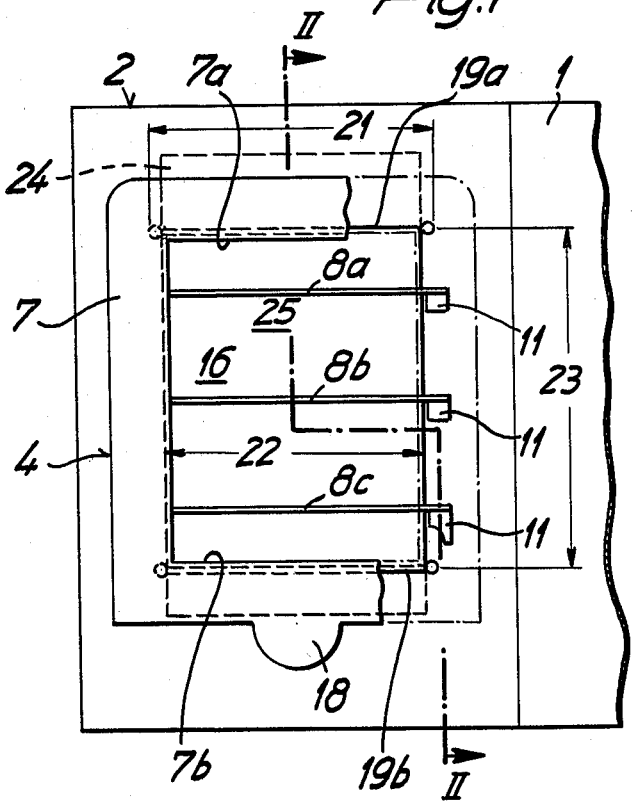
Fig.2
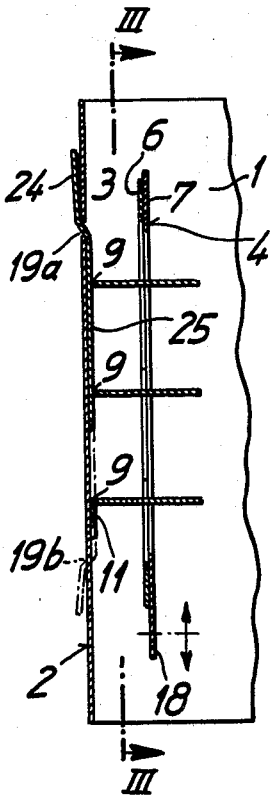

JALOUSIE STRUCTURE

The invention relates to a jalousie card, jalousie board or the like which exhibits a jalousie in front of a display on a card or board area and, in particular, a jalousie in front of an advertisement display or advertisement text.

Jalousie cards which have been used in the past include a card with a jalousie that can be rolled up. This jalousie consists of a multitude of wooden pin lamellaes joined by thread and including a pulling device. The jalousie cards mentioned previously have the advantage of easy manufacture from a single material, e.g., paper board, and they are also more rugged and do not require a roll-up mechanism. In addition, the above-mentioned jalousie cards result in a thinner package, since wooden lamellaes are not present; therefore, the package is better suited for mailing purposes. However, even with those, there is a disadvantage in that a display selection must be made prior to the manufacture of the jalousie card. The preliminary display selection is necessary because the lamellaes have to be permanently fastened to the display card for pivotal movement about the card.

The purpose of the invention is to improve the above-mentioned display card or jalousie board in that the display to be covered or exhibited can be attached to the card after the affixing of the jalousie thereto. The display may be changed at any time as desired.

In order to facilitate the changing of the display at any time, the invention provides the display card with a pair of parallel and spaced apart slots, through which a display sheet can be threaded into the display area, from the rear side thereof.

By arranging an exhibit or display on a separate sheet which can be inserted into the display card via the aforementioned slots, it is possible to change the exhibit or display at any time, even while the display card is covered by the jalousie.

The jalousie card or board includes a combination of a jalousie and display card or board. The jalousie includes a punched portion, made from flexible carton material, and consisting of a peripheral frame reinforced by a window frame, and a plurality of lamellaes which are interconnected and parallel to each other, as well as pivotally mounted within the peripheral frame. Each of the lamellaes, which may be integrally formed with the punched portion, preferably has a bonding flap in addition to a folding edge on each of their opposing ends. These features facilitate the pivotal mounting of the lamellaes within the peripheral frame for pivotal movement thereof about a central axis parallel to the side edges of the display card. The punched portion of the jalousie is affixed to the display card or board, at the display area thereof.

The display area is defined by a pair of slots which are parallel to the inner side edges of the peripheral frame. The display sheet is inserted as described above, into the display area via the slots, for close engagement with the display card. It should be noted that the pair of slots are spaced apart to a dimension smaller than the length of the display sheet. The slots have, however, a length dimension that is larger than the corresponding width of the display sheet, or the width of the opening of the window frame.

When a force is applied at the lower rim area of the peripheral frame or window frame for outwardly pulling either frame, the lamellaes in turn pivotally move from a closed position covering the display area with one side thereof, to an open position exposing the display area, i.e., the display sheet, and then again to a closing position covering the display area with the other side thereof.

Further details of the invention and design alternatives thereof, are described in the detailed description of the invention following below.

The invention is shown and explained (exemplified) in the following drawings:

FIG. 1 shows the jalousie card in a top view (the lamellaes are in an open position perpendicular to the card area, and a portion of the frame including the window frame of the jalousie is shown in a sectional view for better understanding of the details);

FIG. 2 shows the same jalousie card of FIG. 1 in a sectional view along line II—II;

FIG. 3 shows the same jalousie card in a section along line III—III in FIG. 2;

Figure 4:
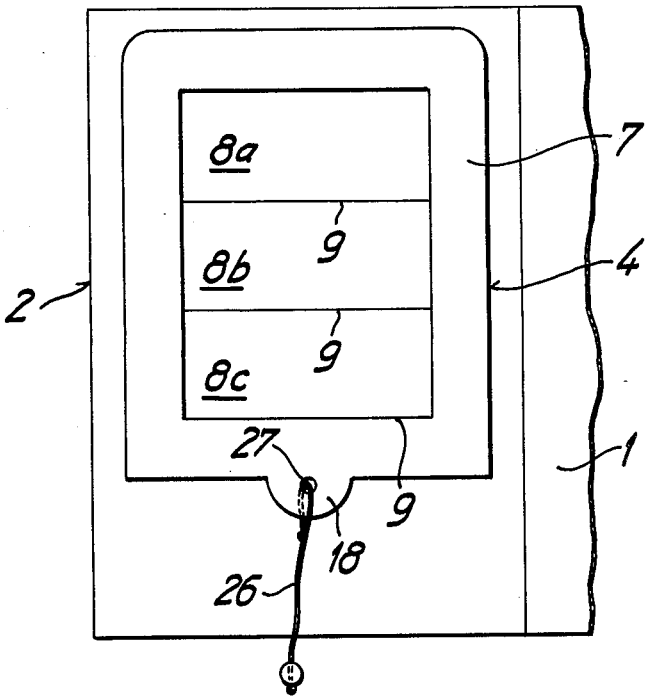
FIGS. 4 and 5 show similar views as shown in FIG. 1 where the lamellaes of the jalousie are turned 180° to each other in both instances covering the card area.

The jalousie card according to FIGS. 1 and 2 consists of a foldable cover sheet 1 covering the display card 2 which carries on its inside section 3, the jalousie explained in greater detail below.

The jalousie 4 consists essentially of a punched part 5 (compare FIGS. 3 and 6) and a peripheral frame 6 of punched part 5 reinforced by window frame 7. The window frame made from the same flexible carton material as punched part 5, is bonded onto frame 6. In addition, punched part 5 as well as frame 6 are punched out from the same carton material having different colors on each side wherein punched part 5 and window frame 7 are facing each other with the same colors.

Figure 6:
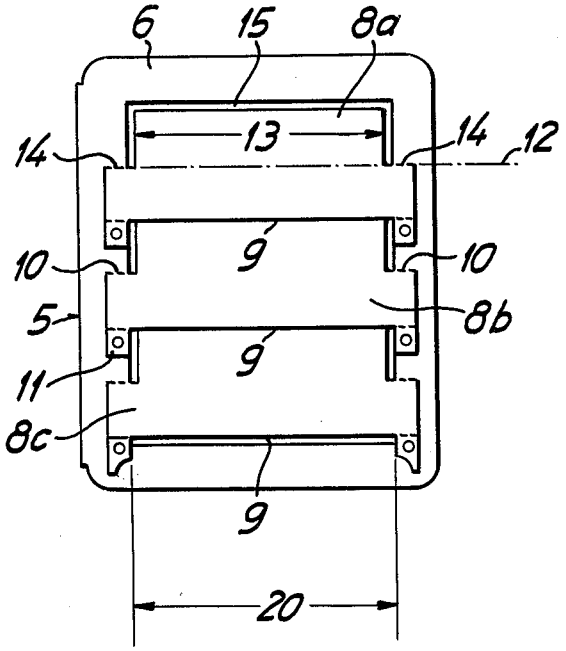
FIG. 6 shows a view corresponding to FIG. 3 showing a punched blank of the jalousie in its original shape when punched out of cardboard.

As can be seen in particular in FIG. 6, the punched part 5 within its frame 6, is forming in its longitudinal direction a succession of lamellaes **8*a*, 8*b* and 8*c* of jalousie 4**. It should be noted that, for reasons of simplicity only, a small number of lamellaes has been chosen for illustration in the drawings and description.

From FIGS. 1, 2, and 6, it can be seen also that the lamellaes **8*a*, 8*b* and 8*c* have a bonding flap 11 carried via edge 9 and a folding edge 10, on each of their opposing ends for pivotal mounting within frame 6 (FIG. 6). Bonding flaps 11 can be bonded to card area 3 (compare FIGS. 1 and 2). On the oppposite side of the bonding flaps 11, the width of the lamellaes 8*a*, 8*b* and 8*c* is shortened to length dimension 13, or is made substantially equal to the width of the opening of the window frame 7, along central axis 12 (FIG. 6) which is parallel to the side edges of the display card as well as to edge 9**.

When FIG. 3 and FIG. 6 are viewed simultaneously, it can be seen that the narrower opening 16 of window frame 7, which is opposite opening 15 of frame 6, exhibits a suitable width 17 matching length 13 to fit lamellaes **8*a*, 8*b* and 8*c*, whereby the side edges of frame 6, which are more or less interrupted, cannot be recognized when the lamellaes 8*a*, 8*b* and 8*c* are opened, more or less because the viewer, according to FIG. 1, will always look through opening 16 of window frame 7**.

As part of window frame 7, an actuator extension 18 is integrally formed or attached to the lower rim area thereof to simplify and make it easier to use the jalousie 4.

According to FIGS. 1 and 2, the display card 2 shows a pair of slots 19*a* and 19*b* in proximity to lamellaes 8*a*, 8*b* and 8*c* and parallel to the inner side edges 7*a* and 7*b* of window frame 7, as well as to the corresponding side edges of frame 6, the length 21 of said slots exceeds length 13 or the width of the opening of window frame 7, or the width of the display sheet (FIG. 6), and approximately equals dimension 20 of the opposite bonding flaps 11.

Through slots 19*a* and 19*b*, a display sheet 24 can be inserted having a width 22 substantially exceeding width 17 of opening 16 of window frame 7, as well as having a length where it exceeds dimension 23 such that the complete area exposed by jalousie 4 (FIG. 2) of card 2 will be covered by sheet 24. As a result, the visible display area 25 of sheet 24 will be sufficient for use as advertisement area carrying the desired exhibit or lettering. This offers the big advantage that jalousie cards without sheets 24 can be produced and stored in large quantities. The purpose and time at which a display sheet 24 is to be inserted into card 2 (of the jalousie card) will be decided on a case by case basis.

The jalousie card preferably will be stored and shipped when the cover is folded and where the jalousie is in its upper position as shown in FIG. 4 when display area 25 of sheet 24 is covered by lamellaes 8*a*, 8*b* and 8*c*. Because of the variety of colors used for the sides of punched part 5 and window frame 7, differently colored sides of the lamellaes 8*a*, 8*b* and 8*c* will appear in window frame 7 according to FIG. 4. When the observer now pulls down window frame 7 by means of actuator extension 18, whereby said window frame and frame 6 of punched part 5 will be lifted off card section 3, after moving down about half the width of a lamella, a position will be reached as it is shown in FIG. 2 where lamellaes 8*a*, 8*b* and 8*c* are positioned perpendicularly to card section 3 and, therefore, reveal to the observer the full view on area 25 of sheet 24. Consequently, the observer can view the complete advertisement area of sheet 24.

Figure 5:
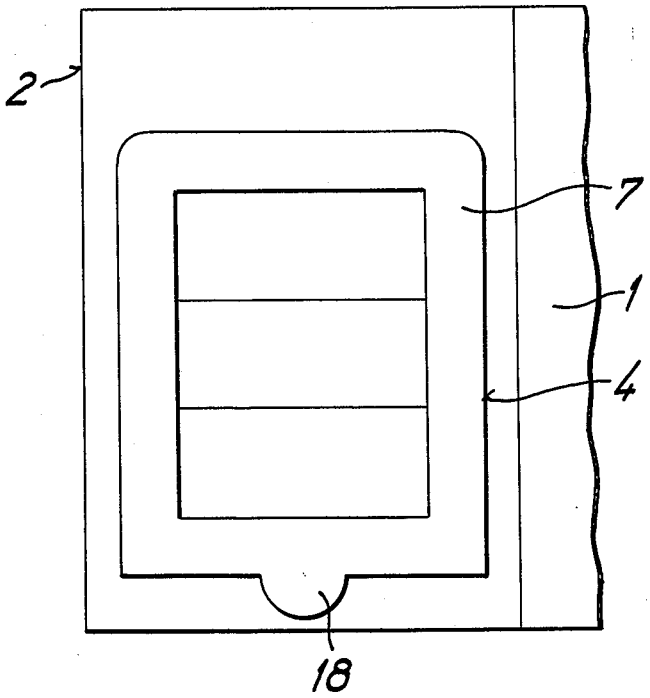

If the observer pulls further on the actuator extension 18 and moves it from a position as shown in FIG. 2 to a position as shown in FIG. 5, jalousie 4 will rest again on card section 3 and sheet 24 and area 25 will be covered by lamellaes 8*a*, 8*b* and 8*c* as well as window frame 7. Based on the same dual color system as mentioned before, the opposite sides of punched part 5 and window frame 7, the exposed lamellae area and window frame 7 appear now in the same color.

Obviously, the sides of the lamellaes 8*a*, 8*b* and 8*c*, with different colors as mentioned, can further be used as additional advertisement area — with pictures and/or text if desired. For example, an advertisement for a pharmaceutical is feasible where the visible side of the lamellae area according to FIG. 4 shows a view of an ailing part of the body, and on the opposite side, a view of the same, in healthy condition, while area 25 of sheet 24 is announcing the medication to be used.

It is to be understood that the invention also encompasses all other possible design embodiments according to the claims of this application, in addition to the embodiments already described therein (as, for example, the number of lamellaes shown are three, but can be more or less). The embodiment of the jalousie card as shown and described above, can on one side be used primarily for advertising purposes because of the simple construction and low cost of manufacturing it. However, it may have other uses, including elaborate construction, e.g., it may be used as a toy or display board where a more rigid construction and more rigid and stronger materials are required for parts of the jalousie. In comparison to the embodiments shown, a more rigid construction can be achieved when window frame 7 and/or frame 6 will be covered or coated by a plastic foil or will be made from some other suitable material. The actuator extension 18, instead of being attached to window frame 7, could be attached to the lower rim area of frame 6, and could assume any desirable shape. At the lower end of frame 6 or window frame 7, or possibly at the actuator extension 18, a string 26 or ribbon or the like could be attached, e.g., threaded into a hole 27 or bonded to the frame and pointing downwardly, so that the jalousie could be operated from a lower position.

Instead of a foldable cover, the jalousie can be placed on a simple sheet or the cover can consist of some sheets which are folded and a jalousie can be provided to some or all of them.

We claim:

1. A jalousie card exhibiting a jalousie in front of a display on a card, which comprises:
   - a punched member having a peripheral frame, said peripheral frame having parallel inner side edges;
   - a plurality of lamellaes pivotally mounted within said peripheral frame, said lamellaes being connected and parallel to each other;
   - a display card having a display area defined by a pair of slots spaced apart, in proximity to said lamellaes and parallel to the inner side edges of said peripheral frame, said punched member attached to said display area of the card, said lamellaes adapted to pivotally move from a closed said display area, wherein said lamellaes are perpendicular to the display area, being parallel to the side edges of the display card and pivotally supported on said peripheral frame, pivoting about a central axis parallel to the side edges of the display card; and
   - a changeable display sheet for insertion through said pair of slots into the display card for close engagement therewith.

2. A jalousie according to claim 1, wherein said lamellaes are integrally formed with said punched member of flexible carton material, and said lamellaes having a bonding flap accompanied by a folding edge on each of their opposing ends for pivotal mounting thereof within said peripheral frame for pivotal movement about said central axis.

3. A jalousie card according to claim 1, wherein said peripheral frame is reinforced by a window frame, made of similar flexible carton material and bonded thereto on the side thereof pointing away from the display card, said window frame defining an opening that is smaller from that of said peripheral frame and having dimensions similar to that of the display.

4. A jalousie card according to claim 3, wherein said pair of slots are spaced apart to a dimension smaller than the length of said changeable display sheet, and the length of said slots is of a dimension exceeding that of the width of the opening of said window frame, so that said display sheet can be threaded through said slots into said display area.

5. A jalousie card according to claim 3, wherein said lamellaes have a bonding flap accompanied by a folding edge on each of their opposing ends for pivotal mounting on said peripheral frame, the width of said lamellaes in the area opposite said bonding flaps being substantially equal to the width of the opening of said window frame along said central axis, so that said lamellaes can pivotally move in and out of said window frame.

6. A jalousie card according to claim 3, wherein an actuator extension is attached to the lower rim of said window frame for pull movement thereof, so that said lamellaes can pivotally move from a closed position covering the display area with one side, to an open position exposing said display area and to another closed position covering said display area with the other side thereof.

7. A jalousie card according to claim 6, wherein said actuator extension has an aperture for receiving a string threadedly attached thereto, so that the jalousie could be operated from a lower position.

8. A jalousie card according to claim 3, wherein said window and peripheral frames are made of cardboard.

9. A jalousie card according to claim 3, wherein said window and peripheral frames are made of a plastic coated cardboard.

10. A jalousie card according to claim 3, wherein said punched member and said window frame are punched out from the same sheet of material.

11. A jalousie card according to claim 3, wherein said punched member, said lamellaes and said window frame are provided with different colors on each side thereof.

12. A jalousie card according to claim 1, wherein said lamellaes are pivotally moveable 180° from a position covering said display area of the card, with one side thereof to another position where said display area is covered by the other side thereof.

13. A jalousie card according to claim 1, wherein said lamellaes are rectangular in shape.

14. A jalousie card according to claim 1, wherein an actuator extension is attached to the lower rim area of said peripheral frame for pull movement thereof, so that said lamellaes can pivotally move from a closed position covering said display area with one side thereof, to an open position exposing the display area and again to a closing position covering the display area with the other side thereof.

15. A jalousie card according to claim 3, further comprising a foldable cover sheet for covering the display card which carries the jalousie.

16. A jalousie card according to claim 15, wherein the display card forms an integral part of said foldable cover sheet.

* * * * *